US005570718A

United States Patent [19]

Smith et al.

[11] Patent Number: 5,570,718

[45] Date of Patent: Nov. 5, 1996

[54] MULTIPLEXING VALVE

[75] Inventors: Trevor S. Smith, West Midlands; John D. Pritchard, Warwickshire, both of England; John H. Buscher, East Amherst, N.Y.

[73] Assignee: Lucas Industries public limited company, West Midlands, England

[21] Appl. No.: 301,132

[22] Filed: Sep. 6, 1994

[30] Foreign Application Priority Data

Sep. 18, 1993 [GB] United Kingdom ..... 9319358

[51] Int. Cl.[6] ..... F15B 13/06

[52] U.S. Cl. ..... 137/596.16; 91/529; 137/596.18

[58] Field of Search ..... 91/526, 528, 529; 137/596.16, 596.18

[56] References Cited

U.S. PATENT DOCUMENTS 4,913,032 4/1990 Wernberg .

FOREIGN PATENT DOCUMENTS 329477 8/1989 European Pat. Off. .
380234 8/1990 European Pat. Off. .
2156105 10/1985 United Kingdom .
2174824 11/1986 United Kingdom .

OTHER PUBLICATIONS

European Search Report, European Patent Application No. 94306368.5.

*Primary Examiner*—Gerald A. Michalsky
*Attorney, Agent, or Firm*—Trexler, Bushnell, Giangiorgi & Blackstone, Ltd.

[57] ABSTRACT

A multiplexing valve is provided having a spool axially movable within a valve casing under the control fluid pressure introduced into variable volume chambers. The spool has passages formed therein such that, with appropriate positioning of the spool, fluid flow communication can be selectively established or inhibited between fluid sources and/or sinks and a given port.

10 Claims, 2 Drawing Sheets

MULTIPLEXING VALVE

BACKGROUND

The present invention relates to a multiplexing valve. Such a valve is suitable for use within the control system of a gas turbine engine.

GB 2 1 74 824 B describes a control system for a gas turbine engine in which a multiplexing valve is connected in series with a servo valve having a single input port so as to selectively supply high pressure air to any one of a plurality of control valves. This arrangement shows a rotary multiplexing valve and control valves which are operated on receipt of successive high pressure pulses, the control valve latching after each movement. Two electrical actuators are required, to operate the servo valve and the multiplexing valve.

EP 329477 shows a similar system with one electrical actuator the multiplexing valve being operated in rotary motion.

OBJECTS AND SUMMARY

According to a first aspect of the present invention, there is provided a multiplexing valve comprising a valve casing having at least first, second and third ports and a first valve member axially movable within the casing for controlling fluid flow between the first port and each of the second and third ports.

Preferably the valve has N ports, where N is an integer, and the valve member is movable to a plurality of Jth positions, where J is an integer between 1 and N–1, inclusive, the Jth position connecting the (J+1)th port to the first port.

Preferably the valve further has an N+1 th port and the valve member is further movable to a further plurality of Kth positions, where K is an integer between 1 and N–1, inclusive, the Kth position connecting (K+1)th port to the N+1th port.

In one embodiment, the valve may have a total of seven ports (i.e. N+1=7). The first port is connected to a first source of fluid at a first pressure and the seventh port is connected to a second source of fluid at a second pressure. The first pressure may be greater than the second pressure. The second source may allow fluid to flow towards it and may act as a sink for the fluid. The second to sixth ports act as inlet/outlet ports and may be individually connected to either to first or second source in response to movement of the valve member.

Preferably the valve member is a spool slidable in substantially fluid sealed engagement within the valve casing.

Preferably the valve further has first and second control ports for supplying fluid to and/or removing fluid from first and second variable volumes defined between a first end of the valve member and the valve housing, and a second end of the valve member and the valve housing, respectively. Flow of fluid to the first and second variable volumes is controlled so as to move the valve member to a desired position. Preferably the fluid flow for controlling the position of the valve member is controlled by an electrically operated servo valve.

Advantageously a second valve member may be provided to cooperate with the first valve member so as to inhibit fluid communication with the second to Nth ports until the first valve member has reached a desired position.

Advantageously a pilot valve may be included so as to isolate the first and N+1 th ports from the source and sink, respectively, until the first valve member has reached a selected one of the Jth or Kth positions. The pilot valve may also control the supply of fluid to the first and second control ports so as to control the fluid supply to the first and second variable volumes, and thereby control the position of the first valve member.

It is thus possible to inhibit the unintentional supply of fluid pressure changes to unselected ports during transit of the first valve member to a selected position.

Preferably a pilot valve member for controlling fluid flow and pressure at outlets of the pilot valve has a first position at which the fluid supply to the first control and second control ports is inhibited and at which fluid communication is provided to the first port of the multiplexing valve. Advantageously, for a multiplexing valve having an N+1th port, fluid may also be provided to the N+1 th port when the pilot valve member is at the first position.

Preferably the pilot valve member is movable to a second position to supply fluid at appropriate pressures to the control ports to move the first valve member in a first direction, and to a third position to supply fluid at appropriate pressures to the control ports to move the first valve member in a second direction opposed to the first direction.

Advantageously the second and third positions encompass respective limited ranges of positions allowing control of the rate of fluid flow to the control ports so as to control the speed at which the first valve member is moved.

Preferably the first valve member has a further position at which the 2nd to Nth ports are connected to predetermined sources of fluid. For example, each port may be connected to the high pressure fluid supply.

According to a second aspect of the present invention there is provided a control system for a gas turbine engine, comprising a plurality of control valves for controlling a plurality of systems of the engine, and a multiplexing valve according to the first aspect of the present invention for controlling the operation of the control valves in response to signals from an engine controller.

The present invention will further be described, by way of example, with reference to the accompanying drawings, in which:

DESCRIPTION

Figure 1:
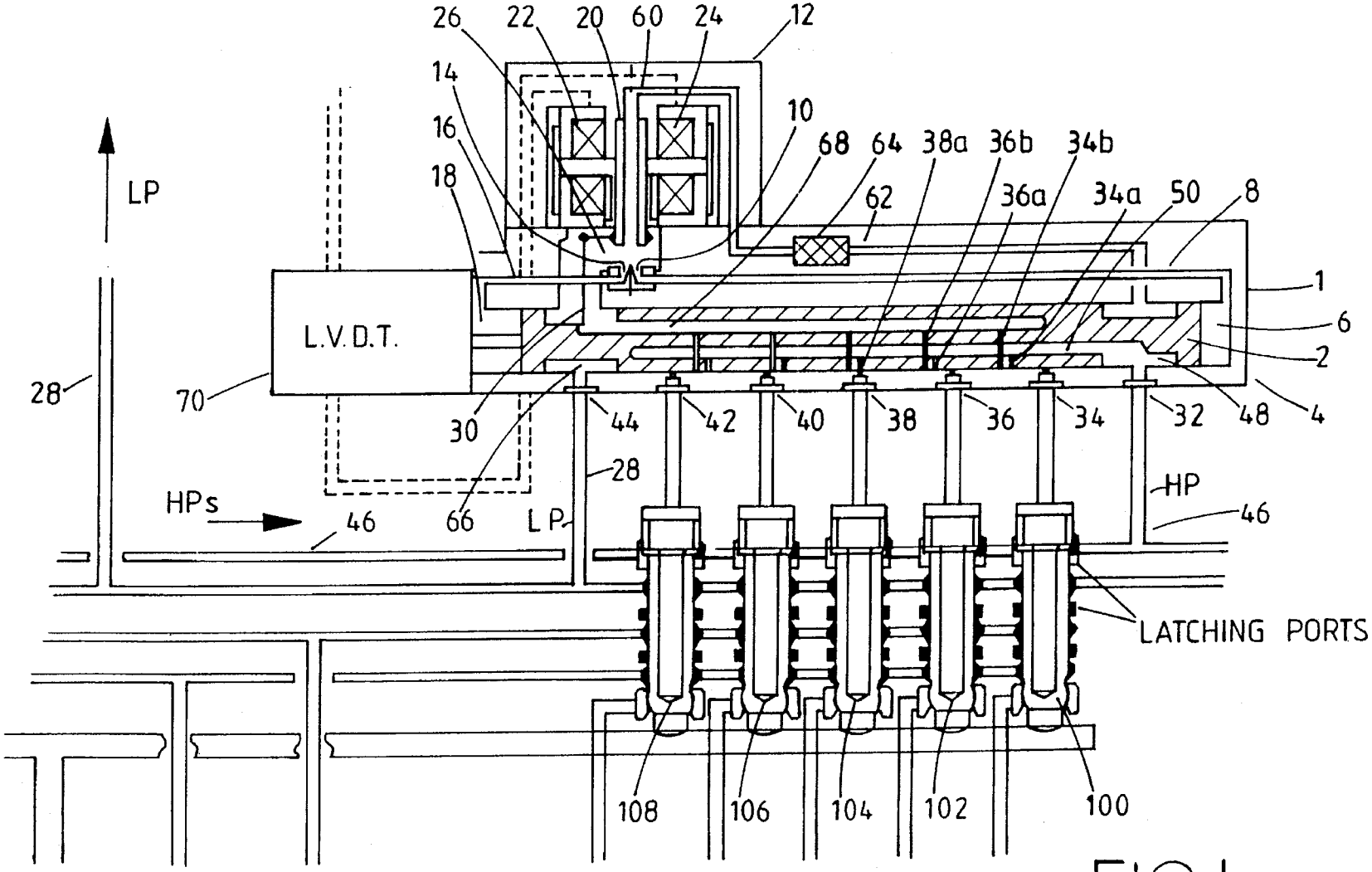
FIG. 1 is a schematic diagram of a valve constituting a first embodiment of the present invention.

A multiplexing valve 1 comprises a spool 2 slidable, in substantially fluid sealed engagement, within a housing 4. A first variable volume chamber 6, formed between a first end of the spool 2 and the housing 4, is connected via a first passage 8 to a first orifice 10 of a servo valve 12. A second orifice 14 of the servo valve 12 is connected via a second passage 16 to a second variable volume chamber 18 formed between a second end of the spool 2 and the housing 4. A jet pipe 20 is movable, in response to energising of magnetic coils 22 and 24, to controllably direct a flow of fuel at a relatively high pressure at the first and second orifices 10 and 14 and to vary the amount of fuel impinging on each orifice so as to control fuel pressure in each of the first and second variable volume chambers 6 and 18, respectively. A region 26 surrounding the first and second orifices 10 and 14 is connected to a low pressure fuel line 28.

A spring or flexible arm 30 is connected between the jet pipe 20 and the spool 2 such that movement of the spool 2 is transmitted to the jet pipe and acts so as to provide positional feedback to the jet pipe so as to maintain the spool 2 at a desired position in proportion to the supply current.

Seven ports are formed in the housing 4 providing fluid communication to the interior of the housing. The first port 32 is connected to a source of fuel at a relatively high pressure via a high pressure fuel line 46. The second, third, fourth, fifth and sixth ports 34, 36, 38, 40 and 42 are connected to control lines for controlling the operation of respective control valves 100, 102, 104, 106 and 108. The seventh port 44 is connected to the low pressure return line 28.

A first annular recess 48 is formed in the spool 2 adjacent the first port 32 so as to permit fluid communication between the high pressure fuel line 46 and a high pressure fuel passage 50 extending longitudinally within the spool 2, irrespective of the position of the spool. A first high pressure fuel control passage **34*a* extends from the high pressure fuel passage 50 to the surface of the spool 2. The passage 34*a* is formed in the vicinity of the second port 34 and is positioned such that it aligns with the second port 34 when the spool is at a first position so as to permit fluid flow communication between the second port and the high pressure fuel line 46**.

Similarly a second high pressure fuel control passage **36*a* extends from the high pressure fuel passage 50 to the surface of the spool in the vicinity of the third port 36 and is positioned such that it aligns with the third port 36 when the spool is at a second position. Third, fourth and fifth high pressure fuel control passages are formed in the vicinity of the fourth, fifth and sixth ports 38, 40 and 42, so as to permit fluid flow communication between the high pressure fuel line and the fourth, fifth and sixth ports when the spool is at a third, fourth and fifth position, respectively. The separation between adjacent high pressure fuel control passages is slightly less than the separation between adjacent ports 34 to 42. Thus only one of the high pressure fuel control passages can align with one of the ports 34–42 when the spool 2** is at any one of the first to fifth positions.

The high pressure fuel line 46 is also in fluid flow communication with an inlet 60 of the jet pipe 20 via a pipe 62 and fuel filter 64.

A second annular recess 66 is formed in the spool 2 adjacent the seventh port 44 so as to permit fluid flow communication, irrespective of the position of the spool 2, between the low pressure return line 28 and a low pressure fuel passage 68 extending longitudinally within the spool 2. A first low pressure fuel control passage **34*b* extends from the low pressure fuel passage 68 to the surface of the spool 2. The passage 34*b* is formed in the vicinity of the second port and is positioned such that it aligns with the second port 34 when the spool is at a sixth position to permit fluid flow communication between the second port and the low pressure fuel line 28**.

Similarly, a second low pressure fuel control passage **36*b* extends from the low pressure fuel passage 68 to the surface of the spool in the vicinity of the third port 36 and positioned such that it aligns with the third port 36 when the spool is at a seventh position. Third, fourth and fifth low pressure fuel control passages are formed in the vicinity of the fourth, fifth and sixth ports 38, 40 and 42**, so as to permit fluid flow communication between the low pressure fuel line and the fourth, fifth and sixth ports when the spool is at an eighth, ninth and tenth position, respectively.

The separation between adjacent low pressure fuel control passages is slightly less than the separation between adjacent ports 34 to 42. Thus only one of the low pressure fuel control passages can align with one of the ports when the spool 2 is at any one of the sixth to tenth positions.

The passages 50, 68, **34*a*–42*a* and 34*b*–42*b* may be formed by drilling the spool 2**.

A linear position transducer 70, such as a variable reluctance displacement transducer, is connected to the spool 2 so as to measure the axial position of the spool 2 and to provide measurements of the spool position to a controller (not shown).

As mentioned herein above, the ports 34 to 42 are connected to control lines of respective control valves 100 to 108. The control valves are half area control valves which may, for example, control the flow of compressed air to actuators. Fuel pressure supplied by the multiplexing valve acts over the full area of a piston within each valve to return the valve to an off position, whereas high pressure fuel acts on half of the piston to move the valve to the on position. The control valves are arranged to latch so that each valve remains in its last selected position when the respective one of the valves is not being addressed by the multiplexing valve 1. A restricted fuel flow path is provided so as to allow restricted fluid flow communication from the high pressure fuel line 46 to the control line of each individual control valve when that control valve is at the off position and to allow restricted flow communication to the low pressure fuel line 28 when that control valve is at the on position. Such a path maintains the valves 100–108 latched at their selected positions.

In use, the spool 2 may be controlled so as move to a rest position in which all the ports 34 to 42 are closed. Suppose, for example, it is desired to switch control valve 104 to the closed position and that the spool 2 is at a position at the most leftward extent of its travel in FIG. 1, i.e. the second variable volume chamber 18 is at minimum volume. The controller (not shown) energises the coils 22 and 24 so as to deflect the jet pipe 20 to direct high pressure fuel towards the second orifice 14. This increases the pressure in the second variable volume chamber 18 and urges the spool 2 to move to the right. Fuel flows out of the first variable volume chamber 6 in response to movement of the spool 2, and travels via the first passage 8 and the first orifice 10 to the region 26 and hence the low pressure fuel line 28. Movement of the spool 2 is monitored by the transducer 70 and the controller adjusts the power to the coils 22 and 24 accordingly.

The position of the spool is controlled such that the high pressure fuel control line **38*a* aligns with the port 38. Thus high pressure fuel from the high pressure fuel line 32 is introduced to the control valve 104 via the high pressure fuel passage 50, the passage 38*a* and the port 38. The control valve 104 latches at the off position. The spool 2 can then be moved to another position, for example to control another of the control valves, without affecting the state of the valve 104**.

Furthermore, the multiplexing valve may also be used to provide proportional control to a non-latching control valve. The spool 2 may be dithered back and forth with respect to a control line of the proportional valve to alternately connect the valve, via a flow restrictor, to the high and low pressure fuel lines, thereby providing proportional control of the valve position. The spool 2 may then be briefly moved to control one or more of the latching control valves before being returned to control the non-latching control valve. During the period of control of the latching control valves, the control line to the non-latching valve is closed by the spool 2, thereby keeping the position of the proportional (non-latching) valve substantially constant.

The control valves provide a latching facility (except for the non-latching valve) and amplification of the control signals to the respective actuators within the engine. The control valves also provide isolation between the fuel used to control the position of the control valves and the compressed air used to operate the actuators. However, in the case of one or more actuators being hydraulically operated and using fuel as the working fluid, one or more of the control valves may be omitted and the or each hydraulic actuator may be connected to receive fuel directly from the multiplexing valve.

Movement of the spool 2 can give rise to transitory connection to unselected ports, giving rise to a brief pressure surge at the or each unselected port. This may be overcome by ensuring that the spool 2 moves rapidly so that the time for which an unselected port is connected to either of the fuel supply lines is brief compared to the response time of the control valves 100–108. Alternatively or additionally the multiplexing valve 1 and control valves 100–108 may be designed such that most of the fuel admitted to the multiplexing valve 1 is used to move the spool 2 and only a little is used to service the ports. This approach enhances the response time of the spool 2 with respect to the control valves 100–108.

As a further alternative, the spool may be enclosed within a movable sleeve such that fluid flow communication cannot occur until the spool 2 and the sleeve are aligned. Thus by arranging the movement of the sleeve to be delayed with respect to the movement of the spool 2, application of fuel pressure to unselected ports is avoided.

As yet a further alternative, the spool may be rotated during the translatory movement of the spool so as to ensure that no fuel is supplied to unselected ones of the ports.

Figure 2:
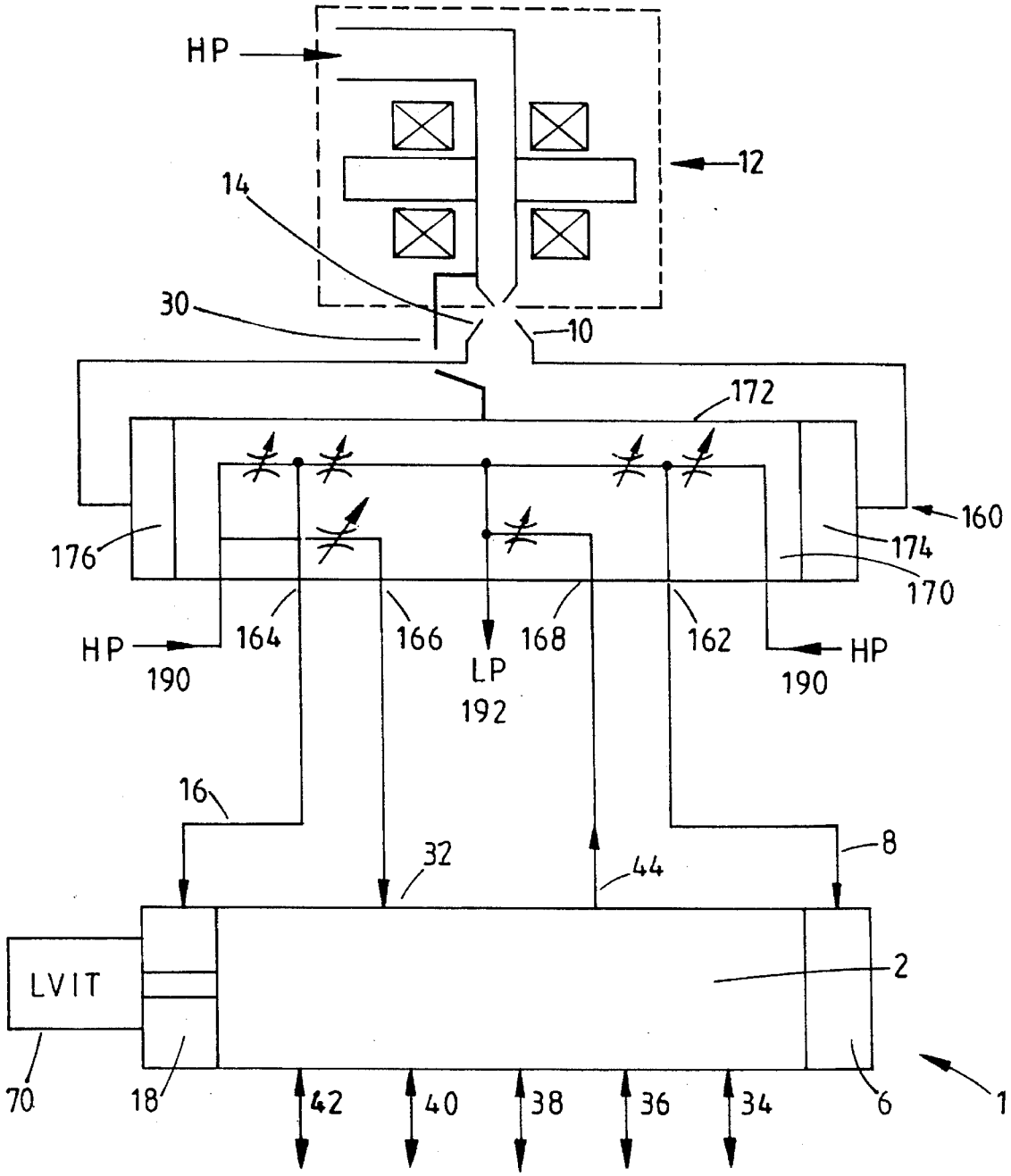
FIG. 2 is a schematic diagram of a second embodiment of the present invention.

A second embodiment of the present invention is schematically illustrated in FIG. 2. A pilot valve 160 is interposed between the multiplexing valve 1 and the servo valve 12, of FIG. 1. The construction of the multiplexing valve 1 is essentially unchanged from that illustrated in FIG. 1, except that the first passage 8 and the second passage 16 do not connect directly to the first and second orifices 10 and 14 of the servo valve 12, but instead are connected to multiplexing valve position control ports 162 and 164 of the pilot valve 160. The first and N+1th ports, i.e. first and seventh ports in the illustration, are connected to fuel supply ports 166 and 168 of the pilot valve, respectively.

The pilot valve 160 comprises an axially movable spool 170 within a valve casing 172. The spool 170 is movable in response to fuel pressure supplied to variable volume chambers 174 and 176 located at each end of the spool. The servo valve 12 is operable, in a manner similar to that described with reference to the multiplexing valve of FIG. 1, to control the position of the spool 170. The position of the spool 170 is fed back to the servo valve 12 via a feedback wire, equivalent to the arm 30 of FIG. 1. The spool 170 has passages formed on the surface of, or within the body of, the spool. The passages are arranged such that at a first spool position the ports 166 and 168 are connected to high pressure and low pressure fuel supplies 190 and 192, respectively, and ports 162, 164 are isolated from said supplies.

The spool 170 is movable under control of the servo valve 12 from the first position to a second position at which control port 164 is connected to the high pressure supply and control port 162 is connected to the low pressure supply, thereby causing the spool 2 of the multiplexing valve to move to the right, as illustrated in FIG. 3, towards a selected position. Ports 166 and 168 are isolated from the fuel supply, thus no pressure is provided to the unselected control valves during the movement of the spool 2. When the spool 2 reaches the selected position, as monitored by the displacement transducer 70 (for example, a linear variable inductance transducer), the servo valve is operated to move the spool 170 from the second position to the first position at which ports 162 and 164 are isolated from the high and low pressure fuel supplies, but ports 166 and 168 are connected to the fuel supplies 190 and 192. Thus fuel is then supplied to operate the selected control valve.

Similarly, the spool 170 is movable, under control of the servo valve 12, from the first position to a third position at which control port 164 is connected to the low pressure supply and control port 162 is connected to the high pressure supply, thereby causing the spool 2 of the multiplexing valve to move to the left, as illustrated in FIG. 2, towards a selected position. Ports 166 and 168 are isolated from the fuel supply. When the spool 2 reaches the selected position, the servo valve is operated to move the spool 170 from the third position to the first position at which ports 162 and 164 are isolated from the high and low pressure fuel supplies and ports 166 and 168 are connected to the fuel supplies 190 and 192. Thus fuel is supplied to operate the selected control valve.

The second and third positions may be ranges of positions having controllable amounts of opening of the ports 162 and 164 so as to control the rate of movement of the spool 2. Thus the rate at which the spool 2 moves can be made dependent on the magnitude of the deflection of the jet pipe of the servo valve 12 from its central position.

Failsafe operation can be provided by arranging that the central position of the servo valve corresponds to a control current to the coils of greater than zero. If a failure causes loss of current to the coils, the torque motor moves to an off-centre position causing fuel to be supplied to a preselected one of the chambers 174 and 176. The spool 170 of the pilot valve 160 is thereby moved to a failsafe position at which fluid communication is established with the chambers 16 and 18 to move the spool 2 to a failsafe position at one extreme of its travel and at which the ports 34 to 42 are connected to a predetermined fuel pressure, such as high pressure.

Failsafe operation may be provided by the provision of additional passages within the output spool 2.

In the event of a failure causing an excess of current to be supplied to the torque motor 12, the torque motor moves to a further off centre position causing fuel to be supplied to the other one of the chambers 174 and 176. The spool 170 is thus moved to a second failsafe position at which fluid communication is established with the chambers 16 and 18 so as to move the spool 2 to a failsafe position in a manner similar to that described hereinabove.

It is thus possible to provide a simple and robust multiplexing valve for controlling a plurality of control valves.

We claim:

1. A multiplexing valve, comprising;

a valve casing defining N ports, where N is an integer greater than two;

a first valve member axially movable within said valve casing and having first and second ends and determining a first variable volume between said first end of said first valve member and said valve casing and a second variable volume between said second end of said first valve member and said valve casing; and a pilot valve, in which;

said first valve member is movable to a plurality of Jth positions, where J is an integer between 1 and (N−1) inclusive, said Jth position connecting a (J+1) port to a first port;

said pilot valve having means for controlling fluid flow to said first and second volumes so as to control a position of said first valve member; and said pilot valve further having means for isolating said first port from one of a fluid source and a fluid sink until said first valve member has reached a selected one of said Jth positions.

2. A valve as claimed in claim 1, in which said valve has an (N+1) port and said first valve member is further movable to a further plurality of Kth positions, where K is an integer between 1 and N−1, inclusive, the Kth position connecting a (K+1)th port to said (N+1)th port.

3. A valve as claimed in claim 2, in which said pilot valve is arranged to isolate said first and (N+1)th ports from respective ones of fluid sources and fluid sinks until said first valve member has reached a position selected from the Jth and Kth positions.

4. A valve as claimed in claim 3, in which said pilot valve further comprises a pilot valve member for controlling fluid flow communication with the first and second variable volumes, said pilot valve member being movable to a first pilot valve position and having means at said first pilot valve position for inhibiting fluid communication with the first and second variable volumes and for providing fluid communication to said first port.

5. A valve as claimed in claim 4, in which said pilot valve has means for allowing fluid communication with said (N+1)th port when said pilot valve member is at the first pilot valve position.

6. A valve as claimed in claim 5, in which said pilot valve member is movable to a second pilot valve position and has means at said second pilot valve position for supplying fluid to the variable volumes to move said first valve member in a first direction, and in which said pilot valve member is movable to a third pilot valve position and has means at said third pilot valve position for supplying fluid to the variable volumes to move said first valve member in a second direction.

7. A valve as claimed in claim 1, in which said first valve member is a spool slidable in substantially fluid engagement within said valve casing.

8. A valve as claimed in claim 1, in which said valve casing further defines first and second control ports in fluid communication with the first and second variable volumes, respectively.

9. A valve as claimed in claim 1, in which said pilot valve further comprises a pilot valve member for controlling fluid flow communication with the first and second variable volumes, said pilot valve member being movable to a first pilot valve position and having means at said first pilot valve position for inhibiting fluid communication with the first and second variable volumes and for providing fluid communication to said first port.

10. A valve as claimed in claim 9, in which said pilot valve member is movable to a second pilot valve position and has means at said second pilot valve position for supplying fluid pressure to the variable volumes to move said first valve member in a first direction, and in which said pilot valve member is movable to a third pilot valve position and has means at said third pilot valve position for supplying fluid pressure to the variable volumes to move said first valve member in a second direction.

* * * * *